United States Patent [19]

Bond, Sr.

[11] 4,095,669

[45] Jun. 20, 1978

[54] SOUND BARRIER

[76] Inventor: William R. Bond, Sr., 20565 NW. Rock Creek Blvd., Portland, Oreg. 97229

[21] Appl. No.: 767,666

[22] Filed: Feb. 10, 1977

[51] Int. Cl.[2] ..... E04B 1/99

[52] U.S. Cl. ..... 181/210

[58] Field of Search ..... 181/210, 287, 284, 285; 256/13.1, 14, 27; 52/144, 145

[56] References Cited

U.S. PATENT DOCUMENTS

| | | | |
|---|---|---|---|
| 3,783,968 | 1/1974 | Derry | 181/210 |
| 3,812,931 | 5/1974 | Hauskins | 181/210 |
| 3,967,693 | 7/1976 | Okawa | 52/145 |

FOREIGN PATENT DOCUMENTS

| | | | |
|---|---|---|---|
| 800,213 | 12/1968 | Canada | 181/284 |

*Primary Examiner*—Robert C. Watson

*Attorney, Agent, or Firm*—Clarence A. O'Brien; Harvey B. Jacobson

[57] ABSTRACT

A sound reducing panel is provided for use in construction of barriers of varying height between sources of objectionable noise and any sensitive area adjacent thereto, such as a freeway, a highway, construction or industrial operations, motors, generators, or other noise generating activity. Each panel consists of a designated number of parallel, hollow, triangular-shaped chambers, equally spaced apart and mounted on the panels in equal spaced relation relative thereto with the triangular-shaped panels opening toward the side of the panel opposing the source of objectionable noise. The mounting of the triangular-shaped chambers in spaced relation relative to the panel provides a specifically dimensioned slot along each longitudinal side of the triangular-shaped chambers opening thereinto and the slots act as side branch filters while the convergent opposite sides of the triangular-shaped chambers extending toward the noise source perform as a series of inverted accoustical horns to channel sound into the chambers through the branch filter defining slots.

10 Claims, 5 Drawing Figures

SOUND BARRIER

BACKGROUND OF THE INVENTION

Various forms of sound barriers utilizing Helmholtz resonating chambers have been heretofore provided, but for various reasons these chambers have been mounted relative to each other in a manner to provide spacing slots therebetween extending through the barrier or the Helmholtz chambers have been mounted on backing panels in spaced parallel relationship relative to each other and with the backing panel including "breathing slots" formed therethrough in registry with the spacing between adjacent Helmholtz chambers. In the first instance, the slots are utilized to render the barrier at least somewhat visually transparent when the barrier is used along a roadway and, in the second instance, the breathing slots are provided to permit air circulation and to also render the barrier somewhat optically transparent. Examples of these two forms of Helmholtz chamber utilizing sound barriers are disclosed U.S. Pat. Nos.: 3,812,931 and 3,783,968. In addition, other sound barriers of somewhat similar construction are disclosed in U.S. Pat. Nos.: 3,630,310, 3,656,576, and 3,382,947.

It was previously believed that limited dimensional slots defined through a sound barrier utilizing Helmholtz chambers did not appreciably reduce the noise attenuation performance of the barrier and were desirable in order to provide a meaasure of visual transparency to the barrier and to minimize a reduction in noise attenuation performance of the barrier due to wind currents incident thereon. More recent studies indicate that the utilization of sound barrier structure provided with Helmholtz chambers and incorporating slots of the above-mentioned type results in appreciable reduction in noise attenuation performance of the barrier.

In addition, most sound barriers utilizing Helmholtz chambers must be reengineered in order to vary the resonance frequency of the barrier in order to adapt it for use in a particular noise abatement environment. Accordingly, a need exists for a sound barrier incorporating Helmholtz chambers and which does not include "breathing slots" or openings and which may be economically produced and "tuned" to a particular resonance frequency whereby the barrier may be specifically adapted for a particular noise abatement situation.

BRIEF DESCRIPTION OF THE INVENTION

The sound barrier of the instant invention utilizes only four distinct components in addition to a backing panel upon which the four distinct components may be mounted. By slightly altering the dimensions and/or spacing between the four distinct components, the barrier may have its resonance frequency varied to suit a particular noise abatement situation. Still further, various materials may be utilized in the construction of the four distinct features of the barrier as well as the backing panel thereof and the barrier is, therefore, readily adaptable for use in numerous environments.

The main object of this invention is to provide an efficient noise attenuating barrier which is readily adaptable to construction in different sizes.

Another object of this invention is to provide a barrier in accordance with the preceding object and including distinct structural features thereof which may be readily manufactured at low cost and from various different materials.

Still another object of this invention is to provide a noise barrier whose construction enables the dimensional size of one or more of the distinct structural features thereof to be varied in order to vary the resonance frequency of the barrier.

Another important object of this invention is to provide a barrier which may be preformed and readily assembled and erected on the site of the desired sound barrier even by unskilleld workmen.

A further object of this invention is to provide a sound barrier which may be constructed from readily available renewable resource materials.

Yet another object of this invention is to provide a sound barrier which is of lightweight construction and is capable of being dismantled, transported and reused elsewhere without effecting its efficiency.

A final object of this invention to be specifically enumerated herein is to provide a sound barrier which will conform to conventional forms of manufacture, be of simple construction and easy to erect, so as to provide a device that will be economically feasible, long lasting and readily assembled.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
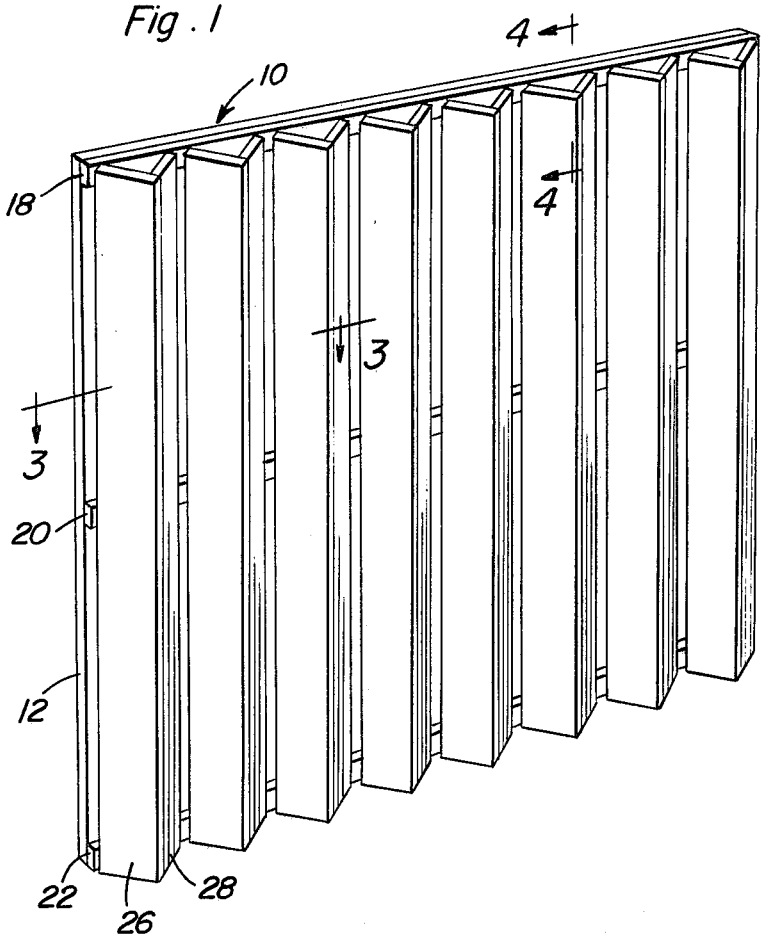
FIG. 1 is a perspective view of a sound barrier section constructed in accordance with the present invention.
Figure 2:
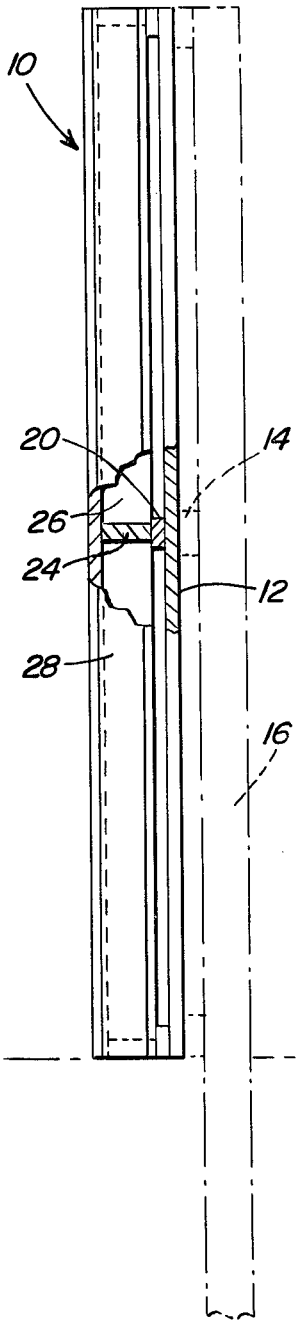
FIG. 2 is an enlarged, side, elevational view of the barrier section illustrated in FIG. 1 as seen from the right side of FIG. 1 and with portions of the barrier section broken away and illustrated in vertical section.
Figure 3:
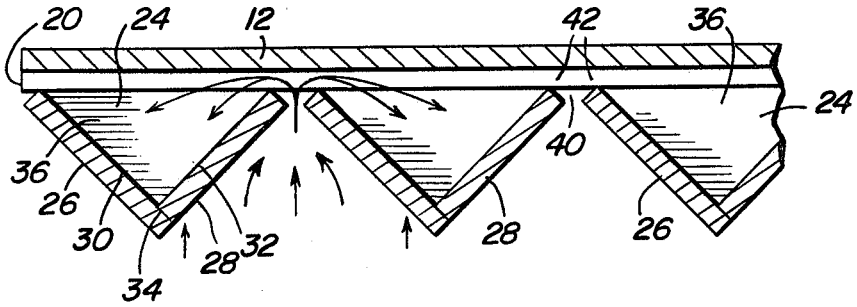
FIG. 3 is a fragmentary, enlarged, horizontal, sectional view taken substantially upon the plane indicated by the section line 3—3 of FIG. 1.
Figure 4:
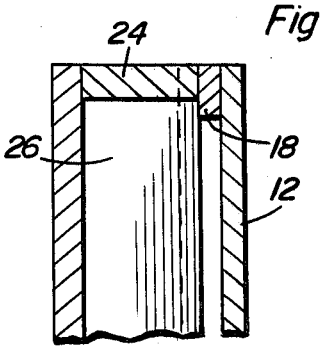
FIG. 4 is a fragmentary, enlarged, vertical, sectional view taken substantially upon the plane indicated by the section line 4—4 of FIG. 1.
Figure 5:
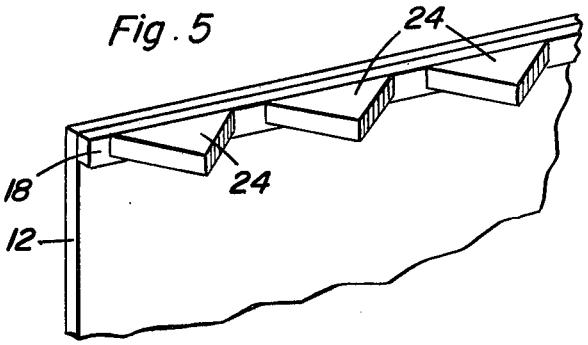
FIG. 5 is a fragmentary, perspective view of the upper portion of the barrier section illustrated in FIG. 1 with the Helmholtz chamber defining slats or panels removed.

Referring now more specifically to the drawings, the numeral 10 generally designates a sound attenuating barrier section constructed in accordance with the present invention. The section 10 may vary vertical height and horizontal length, as desired, and includes a base panel 12 which is imperforate and is mounted from horizontal support members 14 extending between and anchored relative to supportive ground embedded posts 16. It is to be noted, however, that the base panel 12 may be supported in position as desired by other supportive structures.

In addition to the base panel 12, the section 10 includes a plurality of vertically spaced generally parallel mounting strips 18, 20 and 22 disposed over and secured to one side face of the panel 12 upon which sound to be attenuated may be directed. The strips 18, 20 and 2?

comprise spacing strips as will be hereinafter more fully set forth.

Each of the strips 18, 20 and 22 has a plurality of generally horizontally outwardly projecting triangular mounting blocks 24 mounted thereon and spaced longitudinally therealong. The mounting blocks 24 supported from the strips 18, 20 and 22 are arranged in horizontally spaced sets of vertically aligned blocks 24 and each set of blocks 24 supports a pair of panels or strips 26 and 28 therefrom extending along, disposed in surface-to-surface contact with, and supported from corresponding side edges 30 and 32 of the blocks 24, the base edges of the blocks being supported from the strips 18, 20 and 22. The adjacent marginal edges of the strips 26 and 28 are overlapped as at 34 whereby the strips 26 and 28 define Helmholtz chambers 36 of substantially right triangular cross-sectional configuration opening toward the side of the panel 12 from which the strips 18, 20 and 22 are supported. The blocks 24 supported from the strip 20 serve to divide each of the Helmholtz chambers 36 into a pair of vertically spaced Helmholtz chamber sections. The space between adjacent pairs of strips 26 and 28 may be varied by varying the spacing between the sets of blocks 24 and also by changing the dimensions of the blocks 24 and correspondingly changing the width dimensions of the panels 26 and 28. Further, the areas between the panels 26 and 28 and the panel 12 define frequency slots 42 through which pressure waves incident upon the panel 12 between adjacent panel members 26 and 28 may enter the chambers 36. The width of the slots may be varied by using different thickness strips 18, 20 and 22 and the length of each of the chambers 36 may be varied by utilizing additional strips and blocks supported therefrom or additional strips independent of corresponding blocks 24 may be used. Thus, it may be seen that the resonance frequency of the chambers 36 may be varied when designing a barrier section 10 for a particular environmental usage in order that the barrier section 10 may be as effective as possible in noise attenuation performance.

Various materials may be utilized in forming the components 12, 18, 20, 22, 24, 26 and 28 in order to further tailor a given barrier section 10 to the particular environment in which it is to be used.

It is emphasized that the panel 12 is imperforate in order to eliminate any possibility of the barrier section 10 being acoustically transparent and that the width of the slots 42 as well as the openings 40 may be varied as desired in order to "tune" the barrier section 10 for use in a particular noise abatement environment.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A sound barrier including an imperforate backing panel, substantially free of openings therethrough, a plurality of elongated, generally parallel imperforate angle members of substantially V-shaped cross section supported from said backing panel in position spaced slightly outwardly of one side thereof and with the apex portions of said V-shaped angle members facing outwardly of said one side, said angle members being oriented in substantially parallel equally closely spaced apart relation.

2. The combination of claim 1 wherein the spaced apart relation of said angle members relative to each other is substantially equal to their spacing from said backing panel.

3. The combination of claim 1 wherein said one side of said backing panel is substantially planar.

4. The combination of claim 1 wherein each of said angle members comprise a pair of relatively angularly disposed panel portions, each of said angle members including a plurality of support members therefor spaced longitudinally therealong, each of said support members being generally isosceles triangular in plan shape and having their base edges abutted against said one side of said backing panel, said panel portions overlying and being supported from the generally equal length sides of said triangular support members with said triangular support members supporting each angle member dividing the interior thereof into separate chambers spaced apart longitudinally of the corresponding angle member.

5. The combination of claim 4 wherein said angle members are disposed in substantially equally spaced part relation relative to each other and are also substantially equally spaced from said backing panel.

6. A sound barrier including a backing panel, a plurality of elongated generally parallel and closely spaced apart sound energy dissipating imperforate cell bodies supported from said backing panel in position spaced slightly outwardly of one side of said panel, said cell bodies being hollow and including open longitudinal sides opening toward said panel, the longitudinal edges of said cell bodies defining said open sides thereof being substantially coplanar and spaced equally from and generally paralleling said one side of said panel, said panel being at least substantially free of openings therethrough in the areas thereof registered with the spacing between adjacent cell bodies and the areas thereof toward which said cells open.

7. The combination of claim 6 wherein said cell bodies are generally isosceles triangular in cross section with the even length sides thereof diverging toward said one side of said panel.

8. The combination of claims 7 wherein each of said cell bodies comprises a pair of relatively angularly disposed panel portions, each of said cell bodies including a plurality of support members therefor spaced longitudinally therealong, each of said support members being generally isosceles triangular in plan shape and having their base edges supported from said one side of said backing panel, said panel portions overlying and being supported from the generally equal length sides of said triangular support members.

9. The combination of claim 8 wherein said one side of said backing panel is substantially planar.

10. The combination of claim 8 including elongated strips secured to and projecting outwardly from said one side of said backing panel, said base edges being abutted against and anchored relative to the outer sides of said strips.

* * * * *